US005959553A

United States Patent [19]

Raswant

[11] Patent Number: 5,959,553

[45] Date of Patent: Sep. 28, 1999

[54] COORDINATED TWO-DIMENSIONAL PROGRESSION TRAFFIC SIGNAL SYSTEM

[76] Inventor: Subhash C. Raswant, 84-49 168 St., Apt. 1U, Jamaica, N.Y. 11432

[21] Appl. No.: 08/735,335

[22] Filed: Oct. 22, 1996

Related U.S. Application Data

[63] Continuation-in-part of application No. 08/559,008, Nov. 16, 1995.

[51] Int. Cl.[6] ..... G08G 1/095

[52] U.S. Cl. ..... 340/907; 340/910; 340/909; 340/911; 340/934; 340/917

[58] Field of Search ..... 340/907, 910, 340/911, 913, 919, 924, 932; 364/436

[56] References Cited

U.S. PATENT DOCUMENTS 5,278,554 1/1994 Marton ..... 340/910
5,330,278 7/1994 Raswant ..... 404/1

*Primary Examiner*—Jeffery Hofsass
*Assistant Examiner*—Daryl C. Pope
*Attorney, Agent, or Firm*—William B. Ritchie

[57] ABSTRACT

A method of controlling traffic signals on existing grid-like systems of avenues and crossing streets. Two phase traffic signals, red and green, wherein both phases are equal in duration and the amber interval is a part of the green interval. The coordinated two-dimensional progression traffic signal system requires simultaneous changes of the signal cycle at three levels of the designated grid plan. The duration of each phase of the signal cycle is determined by the time required to traverse two contiguous lengths of the optimum grid rectangle. A band length is determinable from the calculation of the duration of the phases and corresponds to the integral number of roadway intersections to be crossed by a vehicle. Between bands, adjacent band widths are in the reciprocal phase from one another. Between avenues, parallel band widths on adjacent avenues and streets are also in reciprocal phases from one another, and between interphases. Interfacing band ends are also in a reciprocal phasing sequence relation to one another, so as to produce a checkerboard pattern of alternating red and green phases of the traffic signals, shown in band interfaces mesh into one another in a saw tooth pattern..

9 Claims, 8 Drawing Sheets

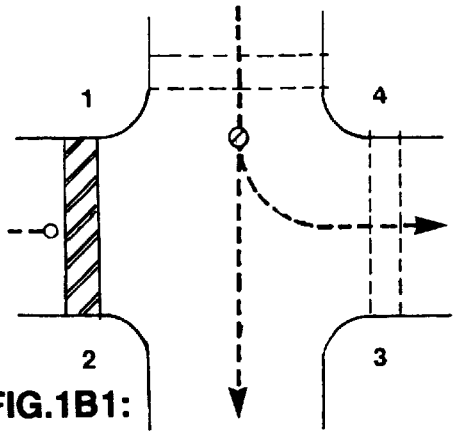
FIG.1B1:
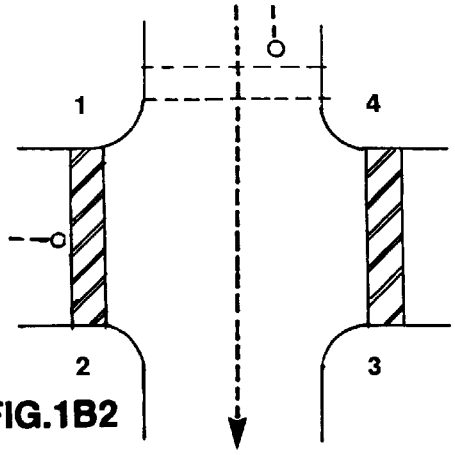
FIG.1B2
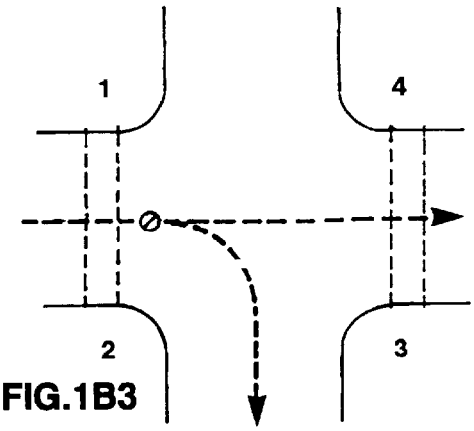
FIG.1B3
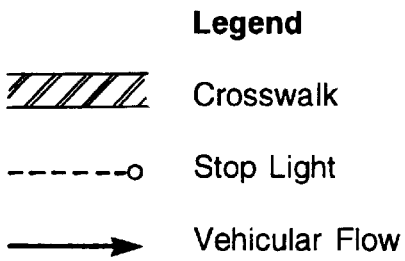
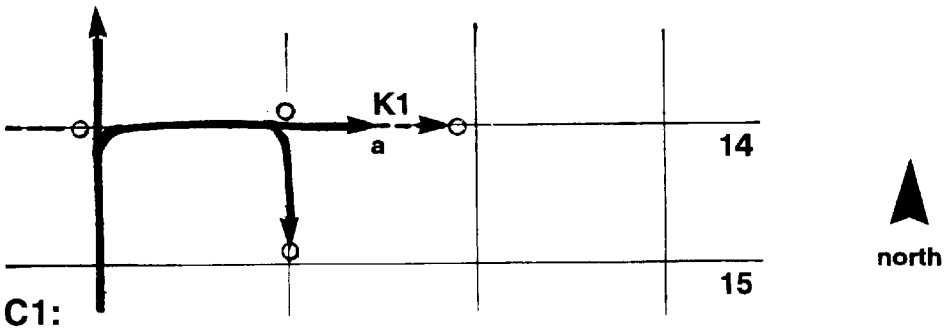
FIG.1C1:
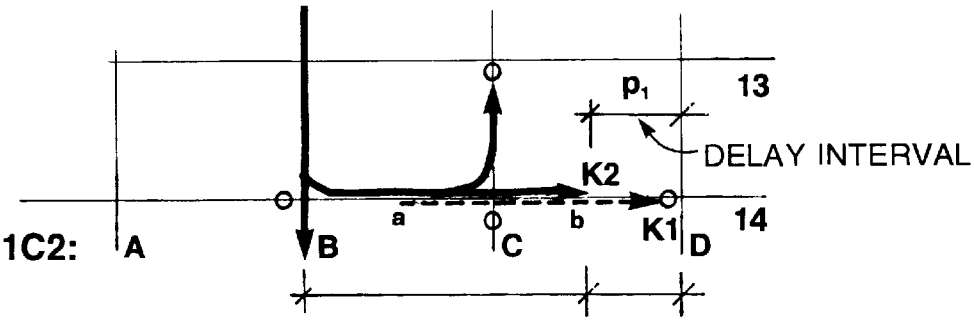
FIG.1C2:

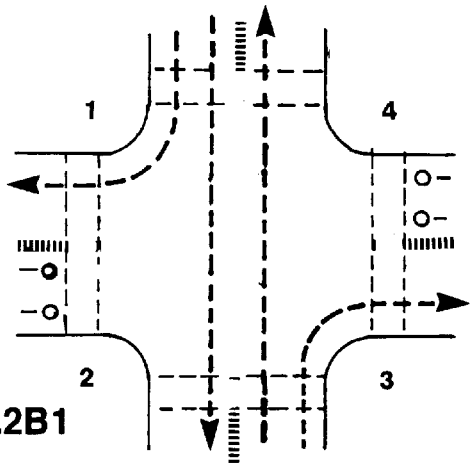
FIG.2B1
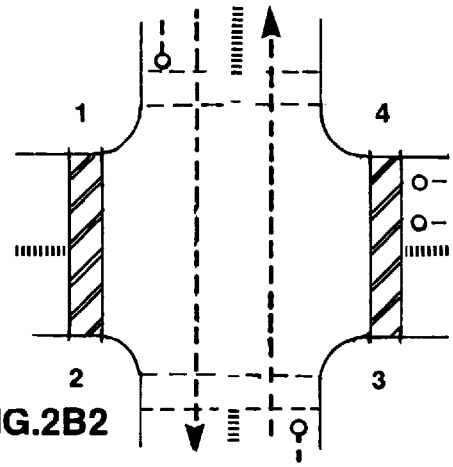
FIG.2B2
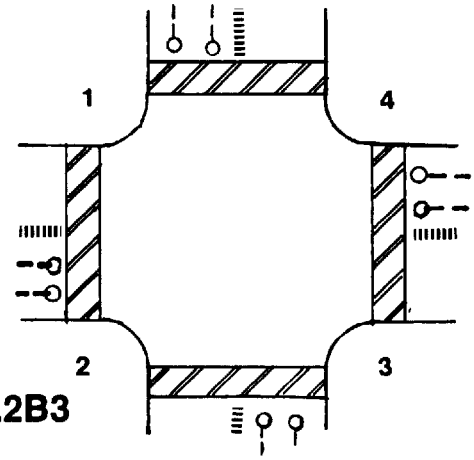
FIG.2B3
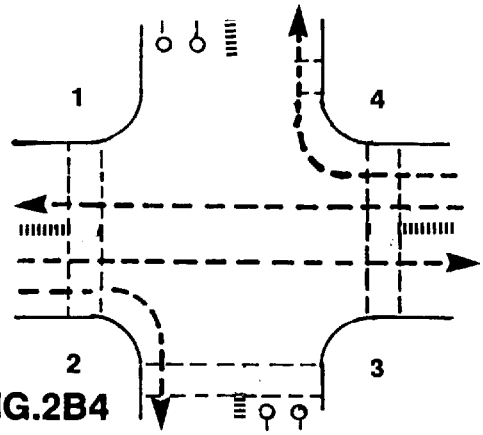
FIG.2B4
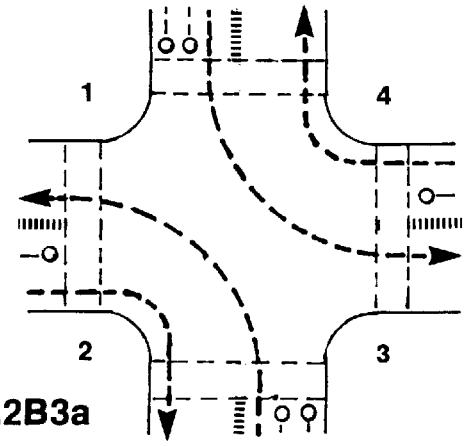
FIG.2B3a
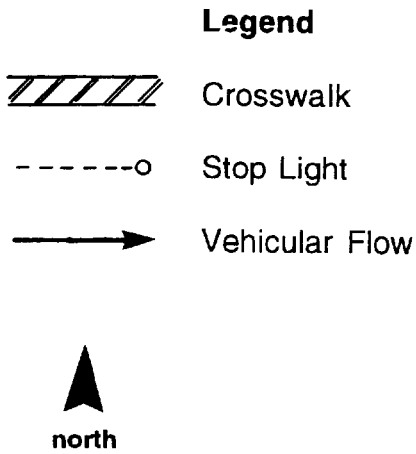

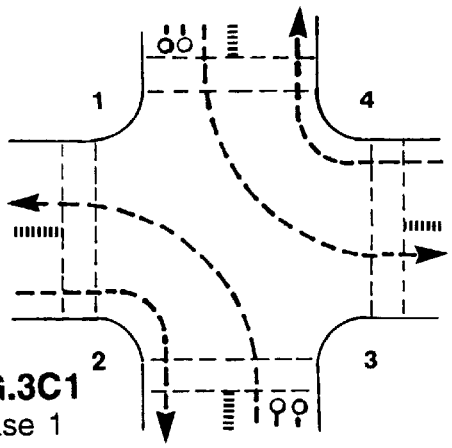
FIG.3C1
Phase 1
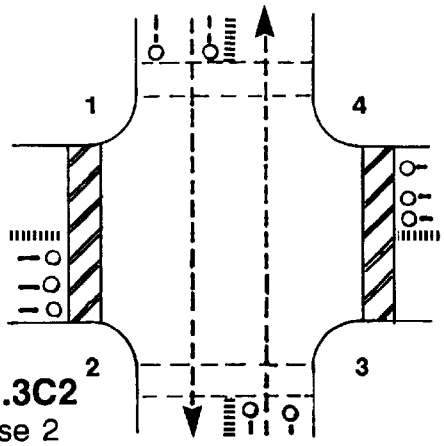
FIG.3C2
Phase 2
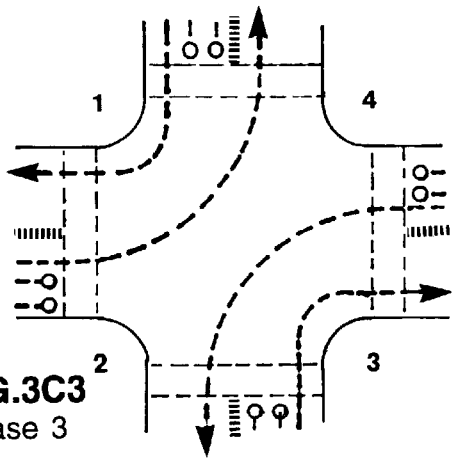
FIG.3C3
Phase 3
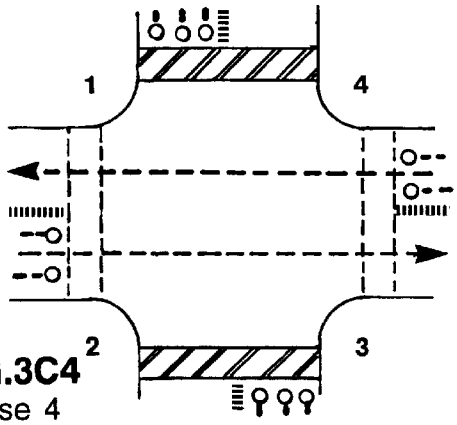
FIG.3C4
Phase 4
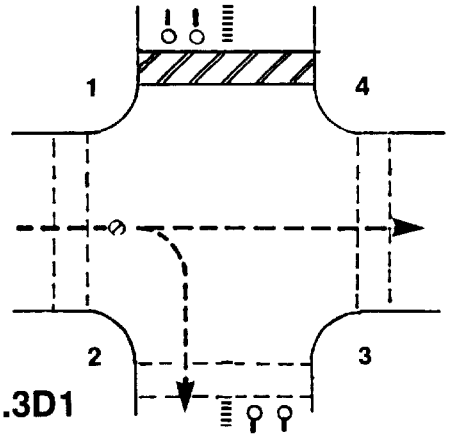
FIG.3D1
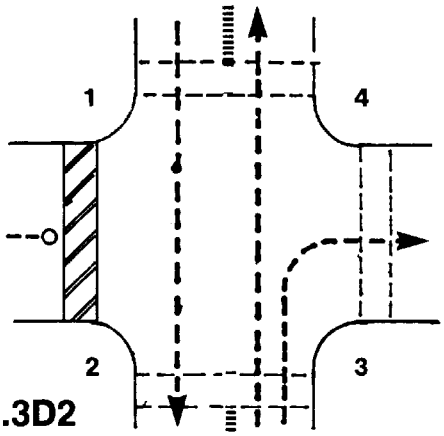
FIG.3D2
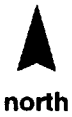

COORDINATED TWO-DIMENSIONAL PROGRESSION TRAFFIC SIGNAL SYSTEM

This application is a continuation-in-part of U.S. patent application Ser. No. 08/559,008, filed Nov. 16, 1995, now pending.

BACKGROUND OF THE INVENTION

1. Field of the Invention

The invention relates to a coordinated system of vehicular and pedestrian traffic flow and traffic light controls.

2. Description of the Related Art

A conventional roadway intersection has two streets, generally perpendicular to one another, with vehicular traffic capable of flowing in both directions on each of the streets. Traffic signals control the movement of the vehicles. In cities, sidewalks are provided for pedestrians to safely move about. They, too, are often directed by traffic signals. Conventionally, these signals are of the "Walk"/"Don't Walk" type which are synchronized with the vehicle traffic signals.

Considering a network of streets as allowing vehicular traffic to travel in the North and South directions, intersecting streets would then allow vehicles to travel in the East and West directions. In the New York City midtown area, for example, wide avenues carry vehicles North and South, while intersecting narrow streets carry traffic East and West. Currently, a backing up or impedance to smooth and continuous vehicular traffic occurs when a vehicle traveling on an avenue in a northerly direction, for example, seeks to make a right or left turn onto the intersecting street to travel easterly or westerly. More specifically, the vehicle seeking to turn off in a northerly direction must wait until the pedestrians cross the intersecting street and clear the crosswalk, prior to making the right-hand or left-hand turn onto the intersecting street. In busy cities, especially during lunch hours and pleasant weather days, only a few cars can transfer from an avenue to the intersecting street as a result of the large number of pedestrians impeding such movement. Similarly, if a car traveling in the northerly direction on an avenue, for example, decides to travel on the intersecting street in a westerly direction, i.e., make a left turn onto the connecting street, the car must also wait in the middle of the intersection until the oncoming cars traveling in the southerly direction on the same street clear the intersection. Next, after being sure that it is safe to cross in front of the oncoming southerly traffic, the vehicle must also be sure that the crosswalk connecting passengers from the southwest and northwest corners is clear of pedestrians, prior to the car turning and then increasing speed on the westerly directed street.

This waiting has a negative impact on the smooth flow of vehicular traffic and can, on peak hours, easily result in gridlock and driver frustration.

Gridlock is a common problem confronting crowded city streets and generally can occur when an intersection becomes blocked by either vehicles desiring to make left-hand turns from streets carrying traffic in two directions (compounded by the necessity of waiting for pedestrians to clear the crosswalks) or by vehicles making either right or left-hand turns from one-way streets, since they must also wait for pedestrian clearance of the crosswalks. The Jul. 17, 1988 issue of the New York Times, published on page E7 an article relating to gridlock and its tremendous negative impact on metropolitan streets and quality of life for city dwellers.

In addition, vehicular traffic is forced to make frequent stops at traffic lights on most city streets to permit crossing movements for vehicular and pedestrian traffic at street intersections. This leads to aggravating delays in travel time and undesired energy consumption.

My U.S. Pat. No. 4,927,288 issued May 22, 1990, offers a simple and efficient means for eliminating the possibility of vehicle gridlock by providing for better traffic flow on existing street networks. The '288 patent discloses a road traffic network, also referred to as the Multiple Loop System (MLS), wherein the fundamental building block is an endless loop of one way traffic flow completely surrounded by the first endless loop and having traffic flow opposite in direction to the traffic flow direction of the first loop with an interconnecting traffic flow roadway between the loops.

Although the '288 patent is effective in providing for a smooth and continuous flow of vehicular traffic on existing roadways, it is not directed to facilitating pedestrian flow nor is there any discussion or solution to the problem of intermodal conflict or friction. Intermodal conflict, as used herein, refers to the slowing of vehicle traffic flow due to a need to avoid accidents or injury involving either two or more vehicular streams of traffic, or a vehicle and a pedestrian stream of traffic at street intersections.

My other already issued patent, U.S. Pat. No. 5,092,705 issued Mar. 3, 1992, relates to a method and system for controlling vehicular and pedestrian traffic at intersections of the Multiple Loop System type disclosed in my '288 patent. In brief summary, the '705 patent relates to a method for controlling the vehicular traffic light signals at intersections of avenues and crosswalks, along with "Walk"/"Don't Walk" traffic signals for pedestrians at the crosswalks, so that the Multiple Loop System operates to its maximum efficiency, all while preserving safety and reducing intermodal conflicts.

Another patent that has relevance to the Multiple Loop System disclosed in my '288 patent is my U.S. Pat. No. 5,330,278 issued Jul. 19, 1994. This patent teaches a method for coordinating traffic signals on a roadway network, preferably of the Multiple Loop System type. Here, two phase traffic signals, red and green, of equal duration are employed at the roadway intersections in such a manner that idling time is minimized while vehicular traffic flow is maximized, all with reduced intermodal conflicts.

Even though the '278 patent is effective at minimizing idling time while maximizing traffic flow, the preferred embodiment of the '278 invention is its application with the Multiple Loop System disclosed in my '288 patent. An inherent disadvantage of the Multiple Loop System is that it does not allow traffic to cross intersections along either axis nor does it accommodate left turns across oncoming traffic due to the one-way looping network configurations. Thus, the '288 patent and its supporting elements in both the '705 and '278 patents provide an efficient road traffic network system only within the context of the Multiple Loop System.

Preferably, a traffic signal system that increases the flow of vehicular traffic on city streets and avenues while minimizing idling time and intermodal conflicts is desired without the need to utilize the Multiple Loop System. Such a system would allow traffic to cross intersections along either axis and to accommodate left-hand turns in special circumstances across oncoming traffic. Implementation of the ideal system onto existing roadways with minimum modifications provides less disruptive service for drivers and allows city planners to make maximum use of the existing roadways. Thus, a traffic network signalization system utilizing existing roadway conditions requiring minimum modifications while allowing traffic to cross along either axis and to accommodate left-hand turns in special circumstances across oncoming traffic is not disclosed in prior art.

SUMMARY OF THE INVENTION

It is an object of the invention to provide a coordinated two-dimensional progression traffic signal system that can be applied to existing grid-like systems of crossing roads or streets and avenues.

It is another object of the invention to provide a coordinated two-dimensional progression traffic signal system that may be applied to one-way grid plans.

It is another object of the invention to provide a coordinated two-dimensional progression traffic signal system that may be applied to two-way grid plans.

It is another object of the invention to provide a coordinated two-dimensional progression traffic signal system that may be applied to any combination of one-way and two-way grid plans.

It is another object of the invention to provide a coordinated two-dimensional progression traffic signal system wherein traffic can cross intersections along either axis.

It is another object of the invention to provide a coordinated two-dimensional progression traffic signal system utilizing existing roadway conditions requiring minimum modifications.

It is another object of the invention to provide a coordinated two-dimensional progression traffic signal system that can accommodate left-hand turns across oncoming traffic for special circumstances in high volume two-way grid intersections.

It is another object of the invention to provide a coordinated two-dimensional progression traffic signal system for simultaneously controlling vehicular traffic light signals on a grid network.

It is another object of the invention to provide a coordinated two-dimensional progression traffic signal system for controlling vehicular traffic light signals at intersections of avenues and cross streets.

It is another object of the invention to provide a coordinated two-dimensional progression traffic signal system for increasing the flow of vehicular traffic on city streets and avenues.

It is another object of the invention to provide a coordinated two-dimensional progression traffic signal system for controlling vehicular traffic light signals in conjunction with "Walk"/"Don't Walk" traffic signals for pedestrians at crosswalks.

It is another object of the invention to provide a coordinated two-dimensional progression traffic signal system that has the timed phases of the vehicular traffic light signals set according to a formula based on safe yet anticipated travel speeds.

It is another object of the invention to provide a coordinated two-dimensional progression traffic signal system for minimizing intermodal conflicts, i.e., accidents.

It is another object of the invention to provide a coordinated two-dimensional progression traffic signal system for minimizing idling time of vehicles in traffic.

It is another object of the invention to provide a coordinated two-dimensional progression traffic signal system for improving travel times of vehicles.

It is another object of the invention to provide a coordinated two-dimensional progression traffic signal system that supports lower fuel consumption levels for the vehicles in transit.

It is another object of the invention to provide a coordinated two-dimensional progression traffic signal system that reduces driver frustration.

It is a final object of the invention to provide a coordinated two-dimensional progression traffic signal system that helps to improve air quality levels in cities.

The invention is a method and system of controlling vehicular and pedestrian traffic flow and traffic light controls on a road traffic network of a type having a plurality of grid-like intersections between a first set of road portions running substantially parallel to one another and a second set of road portions also running substantially parallel to one another, yet at about right angles to the first set of road portions. Two phase traffic signals, red and green, wherein both phases are equal in duration and the amber interval is a part of the green interval are employed. The coordinated two-dimensional progression traffic signal system requires simultaneous changes of the signal cycle at three levels of the designated grid plan. The duration of each phase of the signal cycle is determined by the optimum average time required to traverse two contiguous lengths of a typical grid rectangle on any designated city street system.

BRIEF DESCRIPTION OF THE DRAWINGS

FIGS. 1B1–1B3 illustrate traffic movement at a typical intersection, for both phases of the invention.

FIGS. 1C1–1C2 illustrate a logical progression of vehicular traffic originating at node A/14 in an easterly direction.

FIGS. 2B1–2B4 illustrate traffic movement at a typical two-way intersection.

FIGS. 3B1–3B2 define (in solid lines) the pattern of movement for north/south traffic along one band length during both phases of a signal cycle. Both drawings also illustrate in dotted line the superimposition of a two way flow in the same context.

FIGS. 3C1–3C4 illustrate a four phase sequence of signalization that is designed to eliminate conflicting flows between both vehicular and pedestrian traffic at two-way grid intersections when left turns must be accommodated in special circumstances to support a high volume of turning traffic, and also when the intersection is a major movement corridor for traffic along both legs of the intersection.

FIGS. 3D1–3D2 illustrate traffic flows at a one-way and a two-way intersection.

DETAILED DESCRIPTION OF THE INVENTION

Figure 1A:
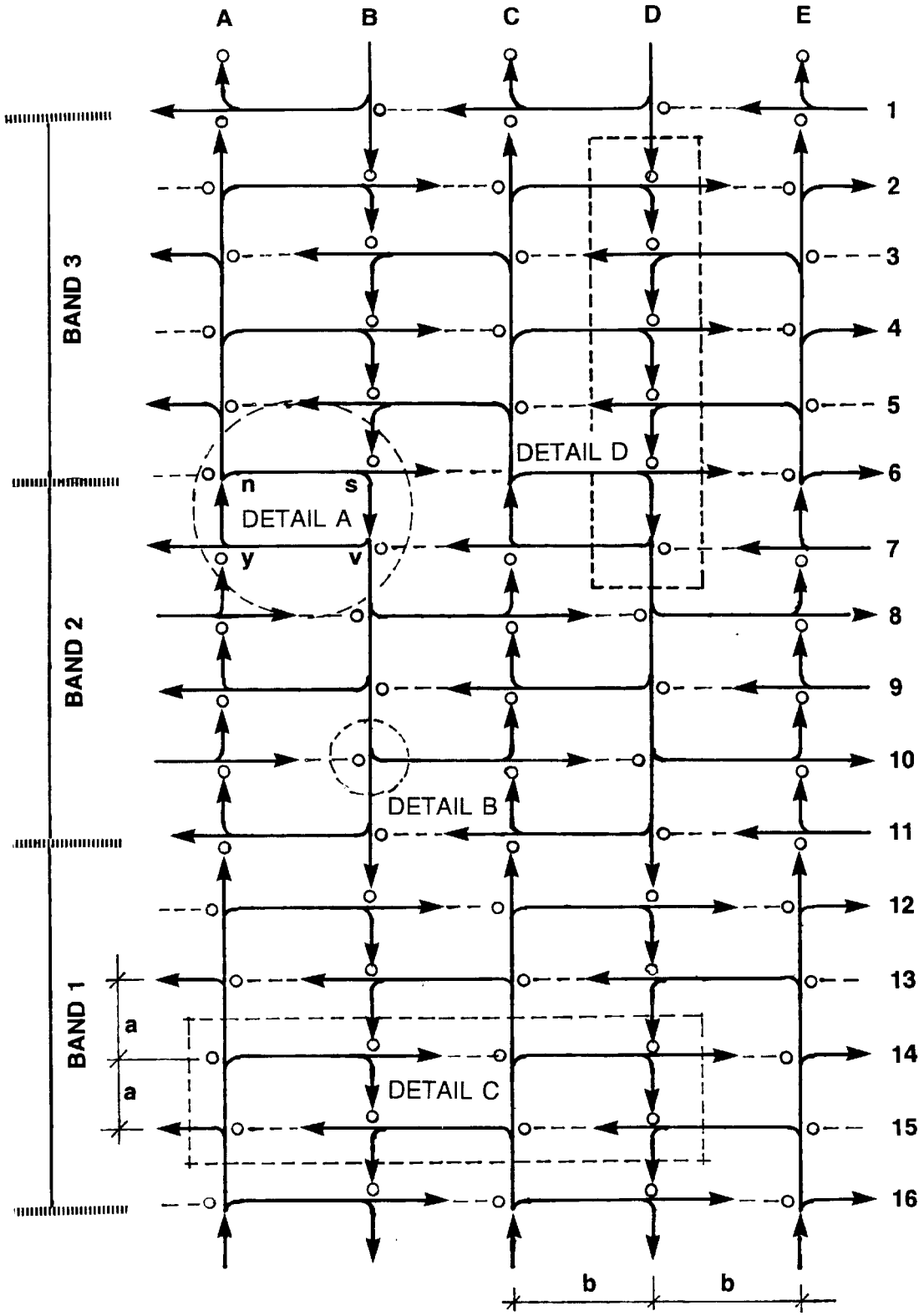
FIG. 1A is a time motion diagram for vehicular movement during the initial sequence of a single phase of a two phase signal cycle on a one-way grid plan, wherein traffic can cross intersections along either axis.

FIG. 1A illustrates a time motion diagram on a one-way grid plan for vehicular movement during one phase of a two phase signal cycle, wherein traffic can cross intersections along either axis. Vehicular flows are highlighted by heavy lines terminating in arrows; red lights are indicated by circular dots; north/south avenues are designated alphabetically "A" through "E"; east/west streets are designated numerically "1" through "19". The north/south alignment of the grid is segmented into three equal band lengths; band 1, band 2 and band 3. The overall appearance is that of an interlocking checkerboard plan. The pattern of movement is such that band lengths in a green phase are either "off-loading" traffic onto the side streets, or moving it forward along the band. Traffic off-loading onto the side streets either moves past the adjacent avenue or it turns off onto an adjacent street, as illustrated.

The invention is designed to operate within the framework of a two-phase signal cycle, wherein both phases are equal in duration and the amber interval is a part of the green interval. Simultaneous changes of the signal cycle at three levels of the designated grid plan are required. (This is in contrast to the present system of signalization of grid-like streets which generally provides for longer green light time for avenue traffic than green light time for crossing streets. The design duration of the signal cycles in existing cities is based on individual need at various locations and are not the result of a broader design pattern.)

All intersections on adjacent avenues within individual bands must function in opposite and reciprocal phases relative to one another. For instance, when intersection lights in band 2 (avenues A, C and E) are at a green signal, traffic lights on adjacent intersections in band 2 (avenues B and D) are in a red phase. Likewise, when avenues A, C and E are at a red signal, traffic lights on avenues B and D are at a green signal.

Simultaneously, street intersections within contiguous band lengths along the avenues are also required to be opposite phases of the signal cycle relative to one another. When intersections in band 2 are in a green phase along avenue C, intersections in contiguous bands 1 and 3 are in a red phase. Likewise, when intersections in band 2 are in a red phase along avenue C, intersections in contiguous bands 1 and 3 are in a green phase.

The band interfaces are not only offset from one another by the length of a typical inter-street distance "a" in a saw tooth pattern, but adjacent band interfaces are also in opposite phases relative to one another. When interface nodes along avenues A, C and E are red along street 11, reciprocal nodes for avenues B and D are red along street 12 in the opposite direction. Simultaneously, when nodes on avenues A, C and E along street 11 are in a red phase, adjacent interface nodes along the same avenues for streets 6 and 16 are in a green phase. Likewise, when nodes on avenues A, C and E along street 11 are in a green phase, adjacent interface nodes along the same avenues for streets 6 and 16 are in a red phase.

In this coordinated two-dimensional progression traffic signal system, the duration of the phase interval "P" is determined by the time required to traverse two contiguous lengths of the optimum grid rectangle plus the addition of a time factor to compensate for a reduction in speed for turning a corner. This time factor is a judgmental value of no more than a couple of seconds which is based on computing analysis of various intersections along each band. Typically, in FIG. 1A, Detail A, "P" is determined by the amount of time required for a vehicle to traverse the distance from node "v" to node "n" via node "y". When the travel distances and times between avenues and streets are determined to be "b" and "$t_b$", and "a" and "$t_a$", respectively:

$$P=t_b+t_a+f_t \text{ (when } t_b>t_a\text{) in seconds} \qquad \text{Equation 1}$$

$$P=2t_b+f_t \text{ (when } t_b=t_a\text{) in seconds} \qquad \text{Equation 1A}$$

Where

P=phase duration in seconds $t_b$=travel time between avenues in seconds $t_a$=travel time between streets in seconds $f_t$=optimum factor for one turn in seconds Equation 1 creates a generic condition where "round the block" maneuvers can be accomplished in exactly two phase changes. When a vehicle travels from node "v" to node "n" via node "y" in a single phase interval it can also travel back to node "v" from node "n" via node "s" in a second phase interval, provided travel speeds and turning conditions remain nearly the same and the turn factor remains the same for both halves of the grid quadrant. In another context (with variety of grid dimensions), "P" may be assigned a numeric value any where between $t_b$ and $2t_b$ (including that in Equation 1) to optimize traffic flow. The exact value to be established by computer simulation results. The parameter $f_t$ is a small value no more than a couple of seconds.

The above example illustrated in a single frame for a two phase sequence of movement that takes place at most intersections but does not mimic the condition represented by Detail A. In fact, this example illustrates a pattern of movement at a typical node where traffic from the side street (in a green phase) simultaneously interfaces with that in the main avenue (also in a green phase). In the context of Detail A, the traffic light at nodes "n" and "y" would simultaneously turn red at the end of Phase 1, while the band length leading to node "n" turns green to create a condition during the succeeding Phase 2 when traffic (originating out of the various nodes along band 2) aggregates at "n" to create a new platoon. (A condition that is further defined in FIG. 3B2, when traffic flows are in a southerly direction.)

A platoon refers to a stack of vehicles. In this context, equations 1 and 1A are relevant only as long as the length of the platoon aggregated at node "n" is equal to or less than the capacity of the avenue segment preceding node "n". In situations when the projected platoon size exceeds the capacity of such an avenue segment, the band length value "N" must be revised downwards to prevent grid-lock.

Band length "N" is the maximum number of street intersections a given platoon length is likely to traverse for the duration of any phase interval "P". Its numeric value "N", rounded off to a whole integer, is determined by the ratio:

$$N=P/t_a \text{ (when } t_b \geqq t_a\text{)} \qquad \text{Equation 2}$$

Where

N=band length

FIGS. 1B1, 1B2 and 1B3 illustrate various traffic flows at a one-way grid intersection, such as the one in Detail B of FIG. 1A. One crosswalk at the forward leg of the major avenue is eliminated (as in my Patent '705) in all three illustrations to enhance safety. Its elimination creates a small inconvenience in terms of an increased crossing distance for pedestrian traffic wishing to use the crosswalk between points 2 and 3 only. It is unchanged for the remaining five situations, i.e., those between points 1 and 2, 1 and 4, 2 and 4, 1 and 3, and 4 and 3. The north/south axis is defined as an avenue, and the east/west axis is defined as a minor side street. Traffic movement representative during both phases of a two phase signal cycle are illustrated in the following paragraphs.

FIGS. 1B1 and 1B2 both illustrate traffic flows in an initial phase "P1" with the phasing interval split in two sequences. FIG. 1B1 defines vehicular flows in a condition where the minor street is at a red light and the major street is green. For the duration of a first sequence "$p_1$", vehicular traffic either crosses the intersection or it turns off the intersection on to a side street. Pedestrian traffic uses the crosswalk between points 1 and 2 only. It is stopped between points 4, 3 and 1. There is no crosswalk between points 2 and 3, as noted earlier.

During the second sequence "$p_2$" of Phase 1, as shown in FIG. 1B2, traffic crosses the intersection but does not turn off on the side streets. Turning traffic must wait for a repeat turning signal. This requires the adoption of a dedicated lane for turning traffic along the N/S Avenue at each intersection. Pedestrian traffic uses the crosswalk between points 3 and 4 and points 1 and 2. Whereas the crosswalk between points 1 and 2 is open for the duration of Phase 1, it creates a relative time disadvantage (equal to "$p_1$") for pedestrian traffic on the crosswalk between points 3 and 4 versus that on crosswalk between points 1 and 2. A solution for neutralizing this disadvantage is discussed later on in the text.

Figure 3A:
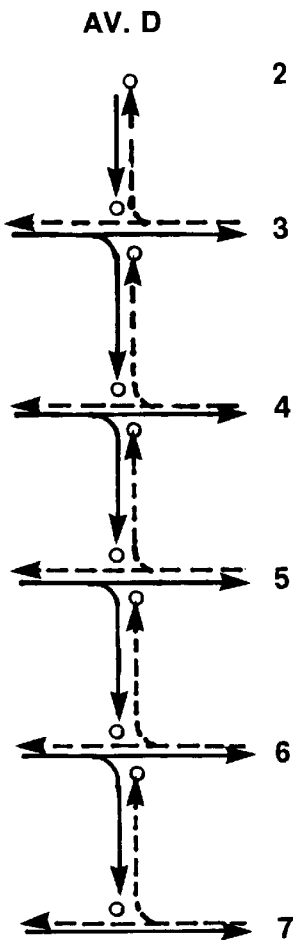
FIG. 3A shows the smallest geographical zone for the completion of one signal cycle on the east/west axis, for one band length along the north/south axis.
Figure 3A:
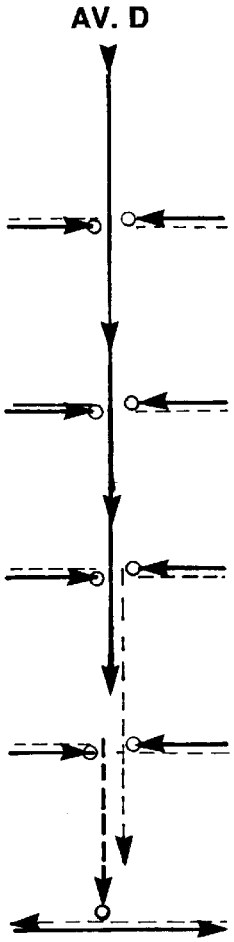
Figure 3A:
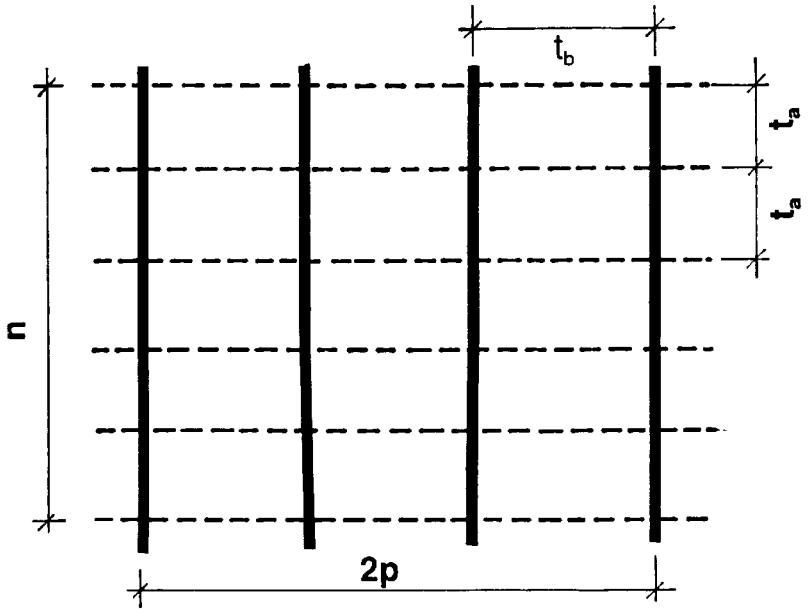

FIG. 1B3 illustrates the second phase "P2" during which the signal cycle is green on the minor street and red on the major avenue. Vehicular traffic is able to proceed through the intersection, as well as to turn on to the major avenue, free of conflict, since there is no crosswalk between points 2 and 3.

The time disadvantage (equal to "$p_1$") resulting from pedestrian traffic on the crosswalk between points 3 and 4 versus that on crosswalk between points 1 and 2 can be neutralized from the information presented in the following paragraphs. In the context of Detail C of FIG. 1A, FIGS. 1C1 and 1C2 illustrate a logical progression of vehicular traffic originating at node A/14 in an easterly direction. During an initial Phase P1 when traffic lights in the north/south axis are green on avenue A and red on avenue B, a vehicular platoon K1 turning east on street 14 off avenue A should normally proceed to a point "a" that is midway between avenues B and C (when $P=1.5t_b$). During the second Phase P2 when traffic lights along avenue B turn green and those along avenues A and C turn red, same platoon K1 should proceed from point "a" to node D/14 provided travel times between node A/14 through D/14 remain constant. Simultaneously, during Phase P2, a second platoon K2 will have originated at node B/14 and progressed to a point "b" midway between avenues C and D, and the offset interval between Platoons K1 and K2 would in this instance be $0.5t_b$ seconds.

The broader implication being that at a given moment preceding phase changes, there are at least two platoons positioned to cross such avenues in an easterly direction and the offset interval between such platoons is contingent on the value of "$P-t_b$". In the context of the developing logic, if platoon K1 were delayed at node D/14 for the duration of the offset interval "$D_1$" between nodes K1 and K2 at the outset of the third phase change P3, platoon K2 would merge with K1 to form an entirely new platoon K3, wherein both the K1 and K2 portions of K3 would progress together to node E/14. Thereafter, the progression cycle would repeat itself the same as it started at node A/14. During this progression cycle platoon K1 will have traversed a distance equal to "4b" in a time interval of "3P" (three phase changes of the signal cycle), and the proportionate time required to cross adjacent avenues is equal to "3P/4". In situations where "$D_1$" is not exercised, the progression cycle for platoon K1 reduces to "2P" and the traverse distance for each cycle is reduced to "3b". Which means that the time required to cross adjacent intersections between avenues is reduced to "2/3P". The potential loss in travel time between avenues resulting out of adopting "$D_1$" is relatively small, i.e., the difference between "2/3P" and "3/4P". "$D_1$" may be adopted in a variety of situations that may include as one option a condition where it is necessary to restore the apparent disadvantage for pedestrian traffic on the crosswalk between points 3 and 4. By adopting the right phase interval "P", the value of "$D_1$" may be made equal to "$p_1$".

Figure 2A:
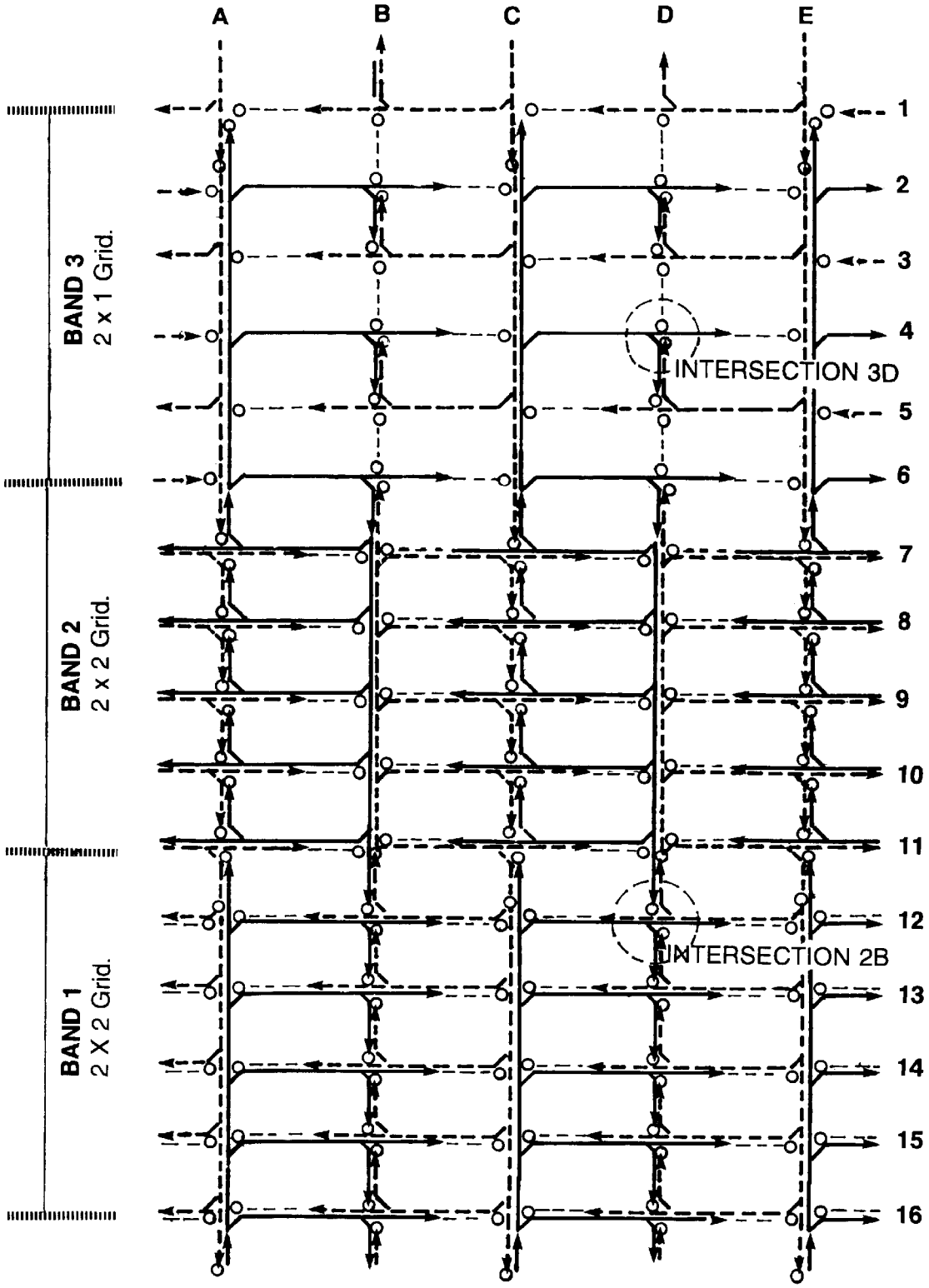
FIG. 2A demonstrates the invention may also be applied to grid networks with two-way streets; and or, on a grid with one-way streets in one direction and two-way streets in the other.

The coordinated two-dimensional progression traffic signal system can also be applied to two-way grid plans. FIG. 2A demonstrates the invention applied to grid networks with two-way streets as in bands 2 and 3 or, as in band 1 to grid networks with two-way and one-way streets, provided left turns are prohibited in either situation.

Traffic flow on two-way intersections remains the same as those in the one-way street system, as demonstrated by FIGS. 2B1 through 2B4 inclusive (when left turns are prohibited). FIGS. 2B1, 2B2 and 2B4 are the functional equivalent of FIGS. 1B1, 1B2 and 1B3 respectively. FIGS. 3D1 and 3D2 (Intersection 3D of FIG. 2A) illustrate traffic flows at a one-way and a two-way intersection. Such intersections also behave like one-way intersections when left turns are prohibited.

Optional delays may be applied on two-way intersections to accommodate special situations. As a first option, FIG. 2B3 shows the movement of pedestrians on the crosswalks during the east/west delay "$D_1$". The relative amount of time available to pedestrians on the crosswalks between points 1, 2, 3, and 4 remains equal to "P", the same as that on the one-way system as long as the delay "$D_1$" is applied to such purpose. FIG. 2B4 shows that the advantage derived out of an elimination of one crosswalk across the principle avenue on one-way intersections, i.e., between points 1 and 4 or between points 2 and 3 is now less apparent in two-way intersections in as much as it is not easy to determine the preferred crosswalk to be eliminated to eliminate intermodal conflict between points 1 and 4, and or between points 2 and 3. FIG. 2B4 anticipates and illustrates a possible elimination of the crosswalk between points 2 and 3.

FIG. 2B3*a* creates a second option for two-way intersections wherein the delay "$D_{1a}$" may be applied in lieu of the "$D_1$" condition demonstrated in FIG. 2B3 to accommodate left turns off and right turns into the more important north/south avenue. The adoption of "$D_{1a}$", as in FIG. 2B3*a*, will reduce the amount of time available to pedestrians on the crosswalks between points 1 and 2 and points 3 and 4 on two-way intersections (as a trade-off). However, its adoption in a specific context must be carefully examined on merit.

In contrast to the earlier analysis of east/west movement illustrated in FIGS. 1C1 and 1C2, FIGS. 3B1 and 3B2 define the pattern of movement for north/south traffic along one band length during both phases of a signal cycle. The solid lines and arrows in FIG. 3B1 illustrate the creation of a discrete number of vehicle units at each of the nodes D2 through D7 along band 3 as in Detail D of FIG. 1A when band 3 is in a red phase for north/south traffic (in an initial phase P1). The offset interval between each of these units is equal to "$t_a$". During a second phase change (P2) when band 3 is in a green phase for north/south traffic, each of the sub-units created earlier now aggregates southward at node D7 as the point of formation of a platoon K4, (as long as Node D4 is in a red phase). In such a situation, each of the sub-units contributing to the formation of K4 will experience various levels of delay depending on their separation from D7. The highest delay is for traffic aggregating out of node D6, and the lowest for traffic out of node D2. In the next phase change, when band 2 turns green, K4 will occupy a position similar to that of D2, relative to band B2. The subsequent southward progression of K4 is directly related to the theoretical ability of K4 to move the full band length "N" for subsequent phase changes between bands. This is not easily accomplished and it does not eliminate the various levels of delay described above; nor does it eliminate the potential for congestion at node D7. The N/S flow may be generically progressed in ATBS when the green and red bands are made to progress forwards by an off-set interval equal to $t_a$. This results in a state of dynamic and simultaneous shifting of all bands (both red and green), in their respective flow directions one link at a time during each off-set sequence. This is best illustrated in the following example:

"In FIG. 1A, when Band-2, Avenue B turns green, traffic originating at node B,11 will move southward towards node B, 12 during an initial phase sequence $t_{a1}$; at which point if node B, 12 turns green, traffic reaching node B, 12 will now be free to move southward to node B, 13 during a second phase sequence $t_{a2}$, and so forth. During these sequential changes, the rear interface of Band-2 , node B,6 will also advance southward one intersection at a time for each off-set sequence. A similar sequence is applied to traffic moving in a northerly direction also. Reciprocal signal changes on adjacent bands (described earlier) automatically occur at the end of each phase interval, and, the starting position illustrated in FIG. 1A repeats itself at the end of each signal cycle, or, on the sequential completion of "2n" changes in Band position. This creates a condition of two-way progression for N/S traffic (for grids with one-way avenues).

On two-way avenues the green band widths must accommodate two opposite streams of traffic within the framework of the larger concept, i.e. that of the red and green band widths being equal. Accordingly, the green band width is reduced to "0.5n" and the red band width is increased to "1.5n" for one phase sequence during which the two green streams fully overlap one another on the green bands, (the red and green bands on adjacent avenues are symmetrically configured, and, in opposite phases of the signal cycle during said sequence). In subsequent sequences when the two-way streams have moved past one another, the red and green bands become equal without and overlap (once during each phase of the signal cycle). The time motion diagrams, for the various sequences in such a progression, are somewhat different to that illustrated in FIG. 2A.

The coordinated two-dimensional progression traffic signal system may be modified to accommodate turning movements to two-way intersections in special situations. FIGS. 3C1 through 3C4 illustrate a novel four phase sequence of signalization that is designed to eliminate conflicting flows between vehicular and pedestrian traffic at two-way grid intersections when left turns must be accommodated in special circumstances with high volume of turning traffic and at the intersection of major movement corridors. In ideal circumstances, such selected intersections should have the ability to accommodate dedicated left turn lanes. The logic for FIGS. 3C1 and 3C2 is the same as that of FIGS. 2B1 through 2B3*a*, as explained earlier, including that of the planned delay "$D_1$" for traffic moving along the east/west axis. FIG. 3C4 creates an additional planned delay "$D_2$" to allow for traffic turning left off the minor street into the north/south axis as in FIG. 3C3. It requires an adjustment to "N" as follows:

$$N=(P-D_2)/t_a \qquad \text{Equation 3}$$

Where $D_2$=delay in seconds for traffic turning left

FIG. 3A shows the smallest geographical zone for the completion of one signal cycle on the east/west axis for one band length along the north/south axis. In existing cities where existing street plans were not laid out perfectly uniform, with the coordinated two-dimensional progression traffic signal system in perspective, the values of "P" and "N" will change between districts in a city.

Figure 4A:
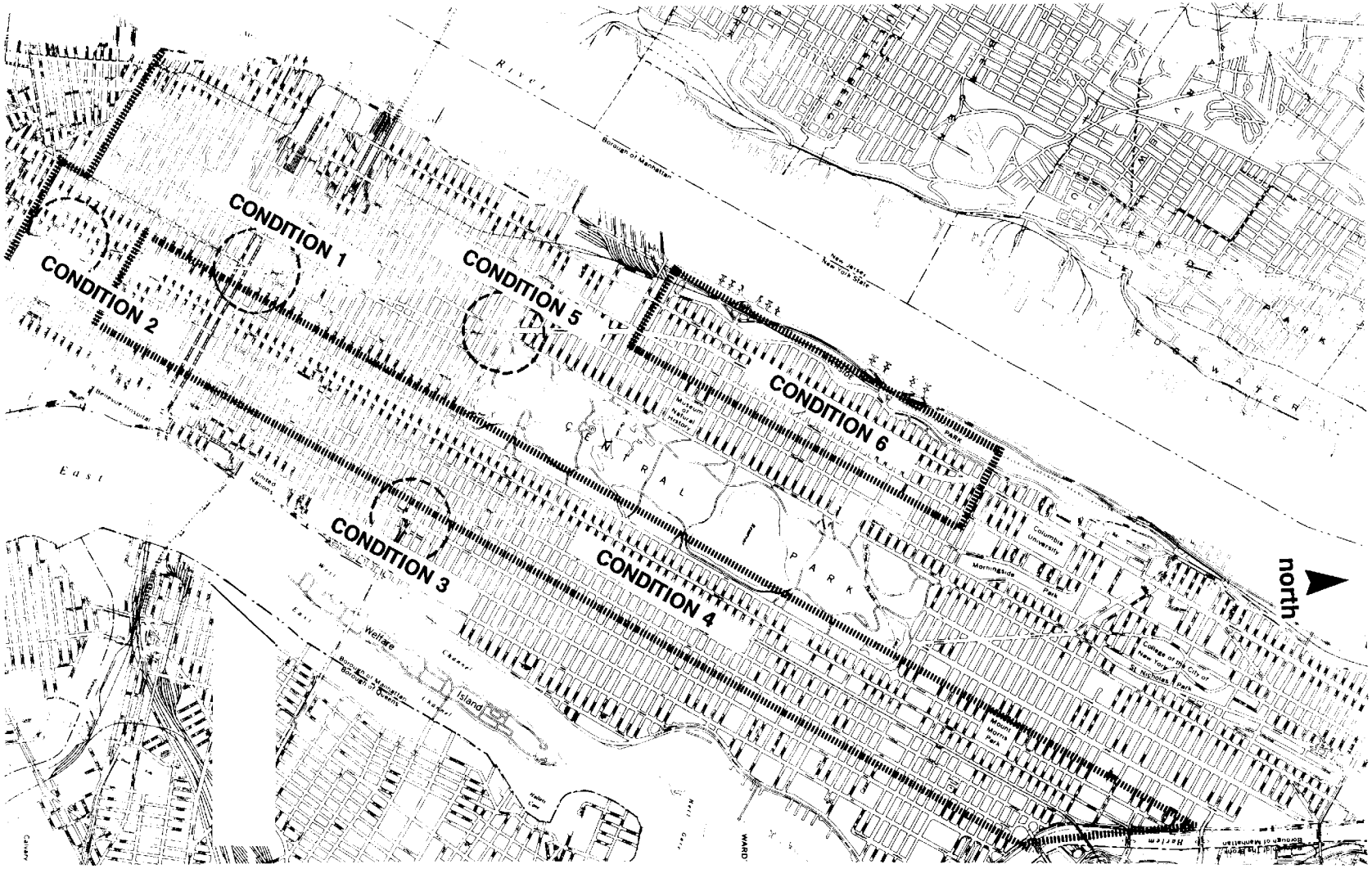
FIG. 4A illustrates some irregularities in the Manhattan street plan through a preliminary division of conditions.
Figure 4B:
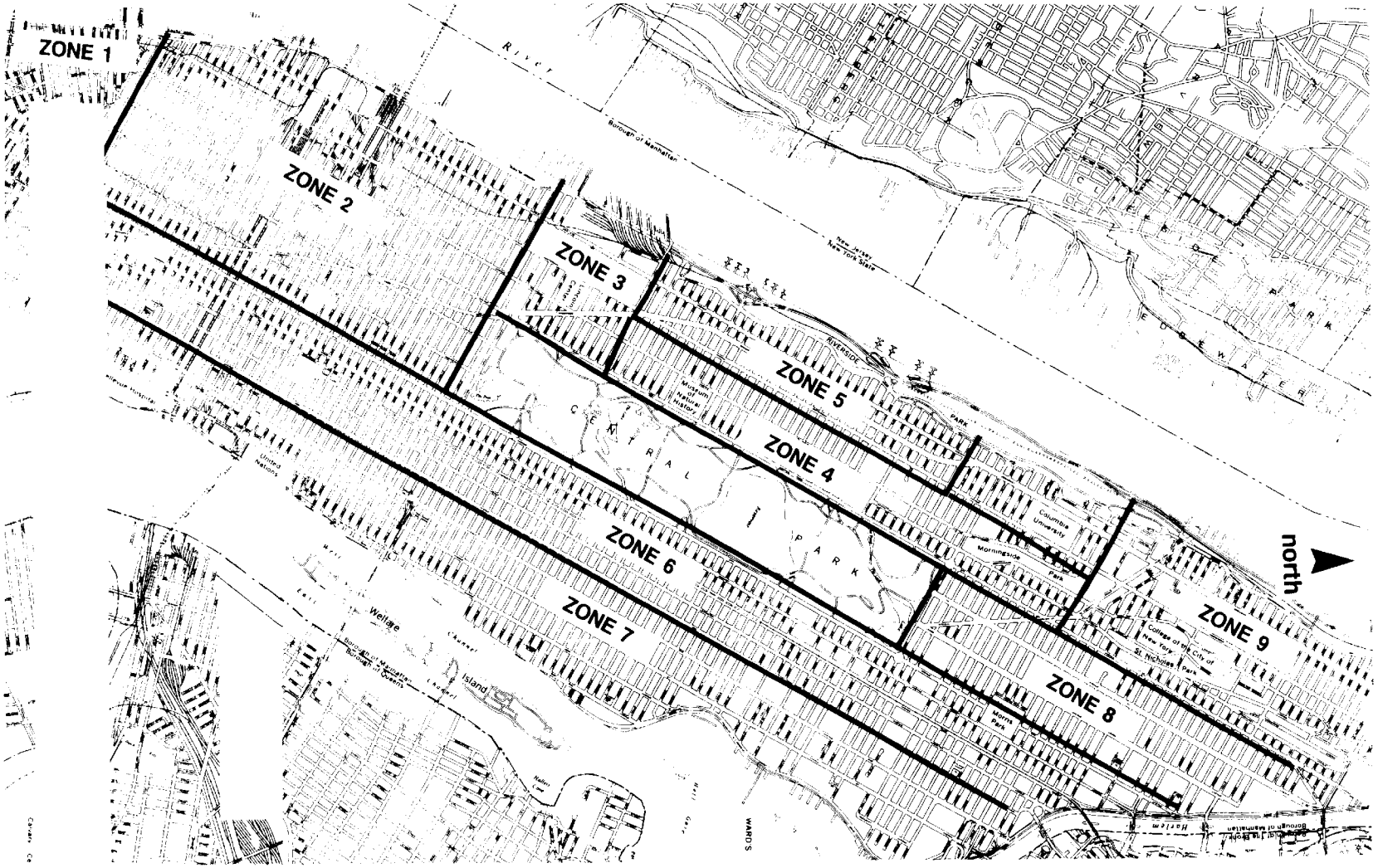
FIG. 4B illustrates a preliminary division of zones on the Manhattan street plan.

The Present Invention Superimposed on Manhattan for Representative Illustration Purposes Basically, traffic flow in Manhattan is based on an irregular model of the one-way grid plan, as illustrated in FIGS. 4A and 4B. Some glaring irregularities are apparent in the Manhattan street plan. As illustrated in FIG. 4A, these include the following five items: 1) Some major streets and avenues, such as 57th Street and Park Avenue are two-way, while others are one-way; 2) A couple of diagonal avenues, such as Broadway, break up the grid iron consistency of the street plan; 3) There are some multi-leg intersections at critical nodes (conditions 1, 2 and 5); 4) There are some critical bridges and tunnels that funnel traffic to or from adjacent communities (condition 3); and 5) The southern tip of the street plan is composed of an irregular grid network, while that north of Houston Street is reasonably consistent.

FIG. 4B illustrates a preliminary division of nine signalization zones based on the readily apparent differences in the network layout of the Manhattan street plan. These do not take into account spot conditions due to city squares, diagonal streets, irregular intersections, etc. An analysis of such conditions are considered outside the scope of this conceptual implementation.

Other traffic conditions that are not as apparent are based on independent field observations by the inventor and readily available in planning and research reports.

For instance, traffic on the Manhattan street system is mostly aligned on the north/south axis. The key operational components of this traffic management system are designed to accommodate the movement of north/south traffic over that of the east/west axis. This is apparent by the progression of traffic lights exclusively aligned along the principle north/south avenues. As reflected in Table 1, trips along the north/south axis typically require two stops per unit mile, while major corridors along the east/west axis require five to seven stops per unit mile. Thus, travel time efficiencies along the north/south axis are offset by the inefficiencies built into the east/west portion of most trips.

Idling time delays were found to range between 26% and 46% of the total trip time during the AM hours, as reflected in Table 1. The average idle time delay for all trips was 38.5% during AM hours. Idling time delays for around-the-block maneuvers required an average time of over 210 seconds during weekday AM hours and approximately 180 seconds for weekend AM hours. Around-the-block trips proportionately add a significant amount of time to the end of trips due to a need for finding limited side street parking spots. These estimates do not factor in delays typical to traffic behavior, such as those encountered from taxis, buses, delivery vehicles, and parking, etc.

As highlighted by conditions 4 and 6 in FIG. 4A, the centerline distance between streets "a" is nearly a uniform constant of 260 feet. The centerline distance between avenues "b" is less uniform, but 720 feet is an accepted norm.

Randomly recorded travel speeds during AM weekday hours without the idling component of Table 1 were 17.5 miles per hour (25.6 feet/second) for the east/west axis and 19.5 miles per hour (28.6 feet/second) for the north/south axis. During weekends, these values increased to 22.5 miles per hour (33 feet/second) for the east/west axis and 25.4 miles per hour (37.25 feet/second) for the north/south axis.

A standard ninety second signal cycle was split into a variety of phasing ratios along 34th Street, as shown in Table 2. The time required to cross the streets on crosswalks along 34th Street varied from 11 to 22 seconds. Thus, any determination of the duration of the phase "P" must be greater than 22 seconds.

Projected efficiencies that could possibly be achieved in travel distances and travel times were determined based upon the coordinated two-dimensional progression traffic signal system as compared to the current system of traffic signalization for Manhattan. Assuming travel speeds remain the same in the coordinated two-dimensional progression traffic signal system as a function of existing attributes, and assuming N/S progression for both systems, relevant phasing intervals are derived by factoring in typical travel speeds and travel distances into equation 1. Equation 1 also includes a time factor that functions as an allowance for turning a corner. Dividing the distances in feet to be traveled by the average speed for each segment expressed in feet per seconds and then adding a time constant to compensate for slowing down to turn a corner derive the phase duration "P". A determination was made that a suitable phase duration for the two phase signal cycle in Manhattan will be 42 seconds for weekdays and 33 seconds on weekends. The value of parameter $f_t$ is assumed to be approximately three seconds during weekdays and four seconds on weekends. Since this is greater than the pedestrian crosswalk time of 22 seconds, pedestrians can to safely utilize the crosswalks.

The results indicate that the progression of vehicular traffic on the east/west axis using the coordinated two-dimensional progression traffic signal system can reduce weekday traverse time between avenues from 71.5 seconds to 31.5 seconds. Similarly, the coordinated two-dimensional progression traffic signal system is expected to reduce weekend traverse time between avenues from 59 seconds to 25 seconds.

Around-the-block maneuvers requiring "2P" in the coordinated two-dimensional progression traffic signal system equate to 84 seconds on weekdays and 66 seconds on weekends. This results in an estimated savings of 126 seconds for a weekday per around-the-block maneuver and 114 seconds for a weekend per around-the-block maneuver.

In both traverse time between avenues and the reduction in the time required for around-the-block maneuvers, projected savings are largely due to the reduction in idling delays. The cumulative and combined effect of both observations can result in substantial savings in travel time and energy consumption.

An estimated calculation of possible savings to be achieved with implementation of the coordinated two-dimensional progression traffic signal system is provided in the following paragraphs. The estimates of energy conservation are a result of the reduction in idling time delays based upon the following numerical values: 1) An idle burn rate of 0.65 gallons/vehicle hour, as determined by the United States Department of Transportation in May 1980, and 2) An assumed 40% allocation to east/west traffic out of an estimated 5,560,000 daily vehicle miles traveled in Manhattan, a figure determined by the New York City Transportation Coordinating Committee in 1994/95.

For weekdays, an east/west traverse savings of 40 seconds per vehicle intersection translates into 293.3 seconds/vehicle mile which, in terms of fuel consumption, equates to 0.053 gallons per vehicle mile. This, when factored into the assumed 2,264,000 of vehicle miles traveled per day for east/west traffic, provides a possible savings of 119,920 gallons per day.

Savings in energy consumption due to a reduction in around-the-block delays is estimated to be 19,128 gallons per weekday. This is based on an assumed round-the-block maneuver at the end of 60% of all trips with the standard length trip in Manhattan assumed to be 4 miles. In other words, take the 5,660,000 daily vehicle miles traveled each day and divide by 4 and then multiplied by 60%. The calculations provide 849,000 trips wherein an additional savings of 126 seconds is realized at the end of each trip on weekdays. Thus, a total energy savings of 139,048 gallons per weekday is derived for the savings in energy consumption due to a reduction in around-the-block delays and in the progression of east/west traffic.

For weekends, an east/west traverse savings of 34 seconds per vehicle intersection translates into 71,316 gallons per weekend day. A 30% reduction in vehicle miles traveled on weekends is assumed in this case. Savings in energy consumption due to a reduction in around-the-block delays is estimated to be 12,198 gallons per weekend day. Again, this is based on an assumed around-the-block maneuver at the end of 60% of all trips with the standard length trip in Manhattan assumed to be 4 miles. That is, take 70% of the 5,660,000 daily vehicle miles traveled and divide by 4 and then multiplied by 60%. The calculations provide 594,000 trips wherein an additional savings of 114 seconds is realized at the end of each trip on weekend days. Thus, a total energy savings of 83,514 gallons per weekend day is derived for the savings in energy consumption due to a reduction in around-the-block delays and in the progression of east/west traffic.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed:

1. A method of controlling vehicular and pedestrian traffic flow and traffic light controls on a road traffic network of a type having a plurality of grid-like intersections between a first set of road portions running substantially parallel to one another and a second set of road portions also running substantially parallel to one another, wherein said first set of road portions and said second set of road portions are substantially perpendicular to one another, wherein traffic can cross intersections, and wherein first set of road portions is further segmented into a plurality of bands of equal lengths, said method comprising the steps of:

providing at each of said intersections, a vehicle traffic signal having two major phases, "go" and "stop" of predeterminable equal time durations;

determing said time duration, based on predetermined expected travel speeds of traffic on said road portions, said grid, and a factor selected based on the time required to turn a corner in said grid;

simultaneously changing the phase of all of said signals at their respective intersections resulting in signals at adjacent first road portions within said band to be in opposite and reciprocal phase with respect to one another and wherein simultaneously changing the phase of all of said signals with adjacent bands are opposite and reciprocal relative to one; and offsetting said bands from one another by a predetermined length selected to correspond to an inter-street distance in a saw-tooth pattern.

2. The method of controlling vehicular and pedestrian traffic flow as claimed in claimed 1, wherein said time duration is about 42 seconds on weekdays.

3. The method of controlling vehicular and pedestrian traffic flow as claimed in claimed 1, wherein said time duration is about 33 seconds on weekends.

4. The method of controlling vehicular and pedestrian traffic flow as claimed in claim 1 wherein the speed during weekdays of said vehicles on said first and second sets of road portions is about 20 and 18 miles per hour, respectively.

5. The method of controlling vehicular and pedestrian traffic flow as claimed in claim 1 wherein the speed during weekends of said vehicles on said first and second sets of road portions is about 25 and 22 miles per hour, respectively.

6. A method of controlling vehicular and pedestrian traffic flow and traffic light controls on a road traffic network of a type having a plurality of grid-like intersections between a first set of road portions running substantially parallel to one another and a second set of road portions also running substantially parallel to one another, wherein said first set of road portions and said second set of road portions are substantially perpendicular to one another, wherein traffic can cross intersections, and wherein first set of road portions is further segmented into a plurality of bands of equal lengths, said method comprising the steps of:

providing at each of said intersections, a vehicle traffic signal having two major phases, "go" and "stop" of predeterminable equal time durations;

determing said time duration, based on predetermined expected travel speeds of traffic on said road portions;

simultaneously changing the phase of all of said signals at their respective intersections resulting in signals at adjacent first road portions within said band to be in opposite and reciprocal phase with respect to one another and wherein simultaneously changing the phase of all of said signals with adjacent bands are opposite and reciprocal relative to one; and wherein:

$$P=t_b+t_a+f_t \text{ (when } t_b>t_a\text{) in seconds}$$

$$P=2t_b+f_t \text{ (when } t_b=t_a\text{) in seconds}$$

Where

P=phase duration in seconds $t_b$=travel time between avenues in seconds $t_a$=travel time between streets in seconds $f_t$=optimum factor for one turn in seconds.

7. The method of controlling vehicular and pedestrian traffic flow of claim 6 further comprising the step of applying the algorithm of claim 6 to computer software to adjust signal timing on a grid network during discrete time periods as a function of changes in travel speeds as these changes in travel speeds relate to changes in traffic composition and congestion.

8. A method of controlling vehicular and pedestrian traffic flow and traffic light controls on a road traffic network of a type having a plurality of grid-like intersections between a first set of road portions running substantially parallel to one another and a second set of road portions also running substantially parallel to one another, wherein said first set of road portions and said second set of road portions are substantially perpendicular to one another, wherein traffic can cross intersections, and wherein first set of road portions is further segmented into a plurality of bands of equal lengths, said method comprising the steps of:

providing at each of said intersections, a vehicle traffic signal having two major phases, "go" and "stop" of predeterminable equal time durations;

determing said time duration, based on predetermined expected travel speeds of traffic on said road portions;

simultaneously changing the phase of all of said signals at their respective intersections resulting in signals at adjacent first road portions within said band to be in opposite and reciprocal phase with respect to one another and wherein simultaneously changing the phase of all of said signals with adjacent bands are opposite and reciprocal relative to one; and wherein:

$$N=(P-D_2)/t_a$$

Where

N=band length

P=phase duration in seconds $D_2$=delay in seconds for traffic turning left $t_a$=travel time between streets in seconds.

9. The method of controlling vehicular and pedestrian traffic flow of claim 8 further comprising the step of applying the algorithm of claim 8 to computer software to adjust signal timing on a grid network during discrete time periods as a function of changes in travel speeds as these changes in travel speeds relate to changes in traffic composition and congestion.

* * * * *